US012398513B2

(12) United States Patent
Saccomano et al.

(10) Patent No.: US 12,398,513 B2
(45) Date of Patent: Aug. 26, 2025

(54) SYSTEM AND METHOD FOR CONTROLLING PROCESS FLUIDS IN A PLANT FOR MANUFACTURING WEB-LIKE PAPER MATERIAL

(71) Applicant: ANDRITZ Novimpianti S.r.l., Marlia-Capannori (IT)

(72) Inventors: Pietro Saccomano, Marlia-Capannori (IT); Luca Linari, Marlia-Capannori (IT)

(73) Assignee: ANDRITZ Novimpianti S.r.l., Marlia-Capannori (IT)

( * ) Notice: Subject to any disclaimer, the term of this patent is extended or adjusted under 35 U.S.C. 154(b) by 379 days.

(21) Appl. No.: 18/113,760

(22) Filed: Feb. 24, 2023

(65) Prior Publication Data

US 2023/0295872 A1 Sep. 21, 2023

(30) Foreign Application Priority Data

Mar. 16, 2022 (IT) ..... 102022000005126

(51) Int. Cl.
*D21F 5/18* (2006.01)
*D21G 9/00* (2006.01)

(52) U.S. Cl.
CPC ..... *D21F 5/181* (2013.01); *D21F 5/188* (2013.01); *D21G 9/0036* (2013.01)

(58) Field of Classification Search
CPC ..... D21F 5/181; D21F 5/188; D21F 5/20; D21G 9/0036
See application file for complete search history.

(56) References Cited

U.S. PATENT DOCUMENTS

2017/0002515 A1* 1/2017 Saikkonen ..... D21F 5/181

FOREIGN PATENT DOCUMENTS

| | | | | |
|---|---|---|---|---|
| DE | 102010041231 A1 * | 11/2011 | ..... | D21F 5/02 |
| EP | 2896743 A1 | 7/2015 | | |
| EP | 3078772 A2 | 10/2016 | | |
| EP | 3795743 A1 | 3/2021 | | |
| FR | 2733522 A1 * | 10/1996 | ..... | D21F 11/14 |
| IT | MI20090364 A1 * | 9/2010 | ..... | D21F 5/044 |

* cited by examiner

*Primary Examiner* — Abbas Rashid
*Assistant Examiner* — Matthew M Eslami
(74) *Attorney, Agent, or Firm* — Andrew D. Dorisio; Dickinson Wright PLLC

(57) ABSTRACT

Herein described is a plant (10) for manufacturing web-like paper material which comprises a system for controlling process fluids. The plant (10) comprises a first wet half-hood (14), a second dry half-hood (16) and four unidirectional flow regulating devices (28, 30; 34, 40) which, suitably positioned on the return circuits (22; 24) of the mist from both half-hoods (14; 16), allow the parallel operation of such half-hoods (14; 16). A fifth bidirectional flow regulating device (40) allows to selectively operate the half-hoods (14; 16) both in reverse cascade mode, that is releasing the mist coming from the first wet half-hood (14) on the return circuit (24) of the second dry half-hood (16), and then release all the mist coming from both the half-hoods (14; 16), and in direct cascade mode, that is releasing the mist coming from the second dry half-hood (16) into the return circuit (22) of the first wet half-hood (14), to release all the mist coming from both half-hoods (14; 16) into the atmosphere once again.

10 Claims, 1 Drawing Sheet

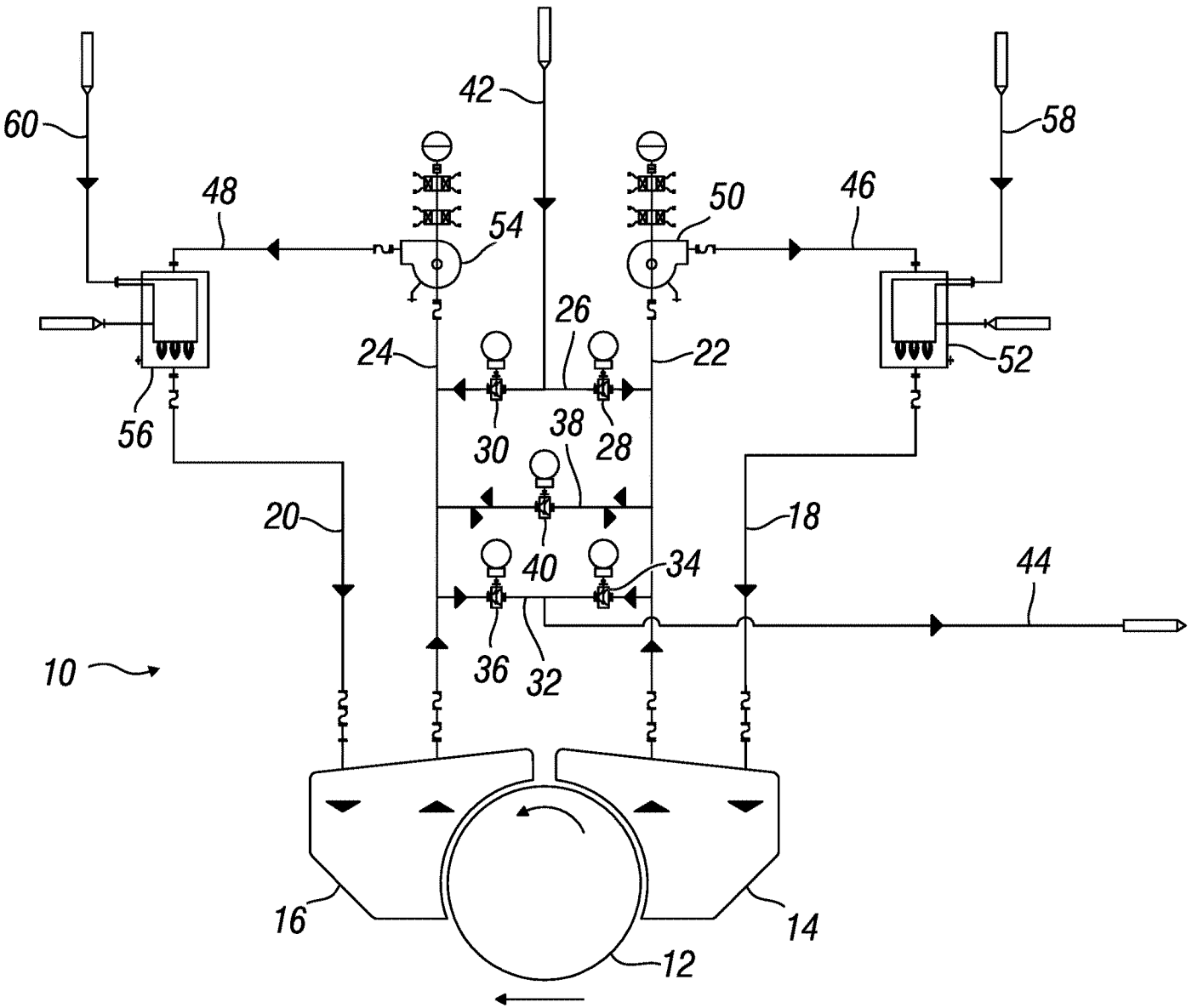
58
52
44
46
18
14
50
22
34
12
28
26
38
40
32
42
54
30
36
24
20
16
48
56
60
10

SYSTEM AND METHOD FOR CONTROLLING PROCESS FLUIDS IN A PLANT FOR MANUFACTURING WEB-LIKE PAPER MATERIAL

This application claims priority to Italian Patent Application No. 102022000005126 filed on Mar. 16, 2022, the disclosure of which is hereby incorporated by reference.

TECHNICAL FIELD

The present invention generally relates to a plant for manufacturing web-like paper material and, in particular, a system and a method for controlling process fluids in a plant for manufacturing web-like paper material.

BACKGROUND

As known, in the general paper production process, and in the tissue paper production process in particular, a step for drying the product being processed by evaporation must be carried out in order to extract the surplus water content thereof. The product to be desiccated, usually consisting of a fibrous slurry based on cellulose and diluted with water, is initially prepared in an appropriate forming equipment and it is therefore delivered to a subsequent drying and desiccating equipment after an intermediate under vacuum extraction step. At the inlet of the drying and desiccating equipment, the slurry which forms the paper sheet being processed contains a low dry part content, which can be equal to about 38%-50%. In other words, after the under vacuum extraction step the slurry may still contain up to 55% and more of water. Therefore, the under vacuum extraction step is not capable of eliminating all the water from the fibres of the slurry, which must therefore be removed by evaporation.

The finished product, typically but not exclusively consisting of tissue paper, requires a dry part content well higher than the values reported above, that is typically equal to about 94%-96%. Therefore, there clearly arises the need to extract from the fibrous slurry, in the drying step by evaporation, most of the residual water content thereof, in order to obtain a sufficiently dry continuous paper sheet. After the drying and desiccation step by evaporation, the paper sheet is stored in reels in order to be subsequently processed (so-called "converting" step) and, lastly, packaged for shipment and final retail sale.

The most common drying and desiccating equipment of the paper production plants, in particular tissue paper, comprise two separate drying devices, which however act simultaneously on the web-like paper material being processed, which is still in the state of fibrous slurry to be desiccated. A first drying device consists of one or more high-efficiency hoods, which blow hot air, at a temperature typically comprised between 300° C. and 650° C., onto the fibrous slurry being processed. Simultaneously with the blowing, the fibrous slurry being processed is placed in contact with the lateral surface of at least one steam-heated dryer, having a diameter usually ranging between about 1.5 m and about 6 m. This dryer, which is usually identified as "Yankee", typically consists of a pressurised container made of cast iron. The container contains a process steam therein at a pressure usually ranging between about 4 bar G and about 10 bar G.

In many drying and desiccating equipment of the paper manufacturing plants, the hood is normally divided into two parts, that is a first half-hood or so-called wet half-hood, which is arranged at the inlet side of the fibrous slurry on the Yankee cylinder, and a second half-hood or so-called dry half-hood which is arranged at the outlet side of the fibrous slurry from the Yankee cylinder. These two half-hoods generally contribute to removing the fumes (usually identified as "mist") coming from the fibrous slurry, given that each half-hood is provided with its own heat generator and with a line for extracting the fumes to be released into the atmosphere. Fume extraction is usually managed by only one fan which provides for suctioning fumes from the respective half-hood and releasing the fumes into the atmosphere using a single chimney. A plant for manufacturing web-like paper material according to the preamble of claim 1, provided with a drying and desiccating equipment which comprises a first wet half-hood and a second dry half-hood, is disclosed for example in document EP 3 795 743 A1.

In the presence of evaporating capacity margins of the drying equipment as a whole, so as to contain the specific thermal consumptions, there is proposed a variant process to the technical solution described above. This process variant provides for removing the whole of the fumes from only one of the two half-hoods. This process variant is defined as a "direct cascade hood". The half-hood from which the fumes are removed is normally the wet half-hood, which is arranged at the inlet side of the fibrous slurry on the Yankee cylinder. The wet half-hood therefore receives the exhaust fumes of the dry half-hood, which is arranged at the outlet side of the fibrous slurry, from the Yankee cylinder.

In particular cases the reverse process, that is the extraction of the whole fumes from the dry half-hood, may be carried out after the latter has received the exhaust fumes of the wet half-hood. This reverse process is defined as "inverse cascade hood".

In recent years, steel has been used instead of cast iron to manufacture the Yankee cylinder. Steel cylinders actually have a thermal exchange capacity greater than that of the cylinders made of cast iron. The steel cylinders also have construction diameters which can reach values greater than those of cylinders made of cast iron, these diameters being limited only by the difficulty of transporting the cylinders.

The use of steel cylinders has caused a significant increase in fumes coming from the fibrous slurry, given that the larger diameter of the cylinder allows to dry a greater amount of fibrous slurry within the same time unit. It should also be considered that the drying of the fibrous slurry becomes more complex as the grammage of the paper intended to be obtained starting from that determined fibrous slurry decreases. For example, as regards drying of fibrous slurry intended for manufacturing toilet paper, whose grammage if particularly low (equal to about 14-18 g/m$^2$ on the winder), on steel cylinders, the amount of fumes is reduced by the maximum speed limit of the drying equipment. As a result, in this drying equipment, the evaporating contribution of the two half-hoods has decreased a lot and, in some cases, and now the hood has the sole function of extracting fumes.

In the drying equipment provided with steel cylinders having a large diameter, as regards low grammage of the paper intended to be obtained, the most appropriate technical solution would be to use the hood in direct cascade mode. However, in order to obtain the maximum flexibility of the plant, one does not necessarily have to give up the possibility of also using hood in reverse cascade mode.

SUMMARY

Therefore, an object of the present invention is to provide a system and a method for controlling process fluids in a plant for manufacturing web-like paper material which are capable of overcoming the aforementioned drawback of the prior art in an extremely simple, cost-effective and particularly functional manner.

In detail, an object of the present invention is to provide a system and a method for controlling process fluids in a plant for manufacturing web-like paper material which allow, at discretion and/or depending on the manufacturing needs, to use the two half-hoods in direct cascade mode, in reverse cascade mode and even in the standard parallel operation mode.

This and other objects according to the present invention are attained by providing a system and a method for controlling process fluids in a plant for manufacturing web-like paper material as outlined in the independent claims. Further features of the invention are outlined by the dependent claims, which are an integral part of the present description.

BRIEF DESCRIPTION OF THE DRAWING

The features and advantages of a system and a method for controlling process fluids in a plant for manufacturing web-like paper material according to the present invention will be more apparent from the following exemplifying and non-limiting description, with reference to the attached drawings in which the only FIGURE is a schematic view which shows both a part of the drying and desiccating equipment and a preferred embodiment of a system according to the present invention for controlling process fluids in a plant for manufacturing web-like paper material.

DETAILED DESCRIPTION

With reference to FIG. 1, there is actually shown an example of a preferred embodiment of a system according to the present invention for controlling process fluids in a plant for manufacturing web-like paper material. The plant is indicated in its entirety with reference numeral 10 and it comprises, in a per se known manner, a drying and desiccating equipment which is designed to desiccate slurry of paper material, so as to convert it into web-like paper material. The slurry of paper material is made using any forming equipment of the known type, which—therefore—will not be described hereinafter.

In detail, the drying and desiccating equipment of the plant 10 comprises a first drying device, in turn comprising at least one rotary dryer 12 supplied with pressurised steam. The slurry of paper material adheres dynamically on the lateral surface of the dryer 12. Therefore, the cylinder 12 is of the so-called "Yankee" type and it is supplied with live steam at a predefined operating pressure, preferably comprised between about 4 bar G and about 10 bar G. Condensing on the inner surface of the Yankee cylinder 12, the steam transfers heat to the outer surface of the Yankee cylinder 12, that is the surface on which the slurry of paper material being dried adheres.

The drying and desiccating equipment of the plant 10 further comprises a second drying device, in turn comprising at least one hood 14, 16 which at least partially wraps the Yankee cylinder 12. The hood consists of a first half-hood 14 and at least one second half-hood 16 which are both capable of blowing high temperature dry air on the slurry of paper material wound on the lateral surface of the Yankee cylinder 12 and suctioning the hot and moist fumes released by the slurry of paper material. In detail, the first half-hood 14 is a so-called wet half-hood, which is arranged at the inlet side of the slurry of paper material on the Yankee cylinder 12, while the second half-hood 16 is a so-called dry half-hood, which is arranged at the outlet side of the slurry of paper material from the Yankee cylinder 12.

The drying and desiccating equipment of the plant 10 further comprises at least one first delivery circuit 18, designed to supply high temperature air to the first wet half-hood 14, and at least one second delivery circuit 20, designed to supply high temperature air to the second dry half-hood 16. As a result, there are provided for at least one first return circuit 22, designed for suctioning the fumes from the first wet half-hood 14, and at least one second return circuit 24, designed to suction the fumes from the second dry half-hood 16.

As shown in FIG. 1, between the first return circuit 22 connected to the wet half-hood 14 and the second return circuit 24 connected to the second dry half-hood 16 there is interposed a first interface duct 26, which is placed in fluid connection both with the first return circuit 22 and with the second return circuit 24. Along this first interface duct 26 there are installed a first flow regulating device 28 and a second flow regulating device 30. As shown by the arrows of FIG. 1, the first flow regulating device 28 is designed to allow the unidirectional fluid flow from the first interface duct 26 to the first return circuit 22, while the second flow regulating device is designed to allow the unidirectional fluid flow from the first interface duct 26 to the second return circuit 24. These flow regulating devices 28 and 30 installed along the first interface duct 26 preferably consist of sealed regulating valves.

Between the first return circuit 22 connected to the first wet half-hood 14 and the second return circuit 24 connected to the second dry half-hood 16 there is further interposed, upstream of the first interface duct 26, a second interface duct 32, also placed in fluid connection both with the first return circuit 22 and with the second return circuit 24. Along this second interface duct 32 there are installed a third flow regulating device 34 and a fourth flow regulating device 36. As shown by the arrows of FIG. 1, the third flow regulating device 34 is designed to allow the unidirectional fluid flow from the first return circuit 22 to the second interface duct 32, while the fourth flow regulating device 36 is designed to allow the unidirectional fluid flow from the second return circuit 24 to the second interface circuit 32. Also the flow regulating devices 34 and 36 installed along the second interface duct 32 preferably consist of sealed regulating valves.

As shown in FIG. 1, at least one air supply duct 42 is placed in fluid connection with the first interface duct 26 and it is designed to supply air, coming from the environment outside the plant 10, to the first flow regulating device 28 and to the second flow regulating device 30. The first flow regulating device 28 and the second flow regulating device 30 therefore act as valves for delivery towards the return circuits 22 and 24 respectively of the first wet half-hood 14 and of the second dry half-hood 16. In other words, the first flow regulating device 28 and the second flow regulating device 30 act as pre-heated air replenishment valve for the first wet half-hood 14 and the second dry half-hood 16, as better specified below.

Still with reference to FIG. 1, at least one exhaust pipe 44 is placed in fluid connection with the second interface duct 32 and it is designed to release the fumes which flow through such second interface duct 32. The third flow regulating device 34 and the fourth flow regulating device 36 therefore act as valves for adjusting discharge from the return circuits 22 and 24 respectively of the first wet half-hood 14 and of the second dry half-hood 16. In other words, the third flow regulating device 34 and the fourth flow regulating device 36 act as valves for extracting fumes from the first wet half-hood 14 and the second dry half-hood 16.

The pre-heated air is replenished in the first wet half-hood 14 through a first delivery duct 46, which is placed in fluid connection with the first delivery circuit 18 and with the first return circuit 22 and which is designed to send—to the first delivery duct 18—at least one part of the fumes which flow through the first return circuit 22 and at least one part of the air coming from the air supply duct 42. Similarly, pre-heated air is replenished in the second dry half-hood 16 through at least one second delivery circuit 48, which is placed in fluid connection with the second delivery duct and with the second return circuit 24 and which is designed to send—to the second delivery duct 20—at least one part of the fumes which flow through the second return circuit 24 and at least one part of the air coming from the air supply duct 42.

Between the first return circuit 22 and the first delivery duct 46 there is interposed at least one first fan 50, which is designed to transfer—to the first delivery duct 46 the air and/or fumes coming from the first return circuit 22. Between the first delivery duct 46 and the first delivery circuit 18 there is instead interposed at least one first heat generator 52, such as for example a burner, which is designed to heat both the air and fumes coming from the first delivery 46, and further air coming from the environment outside the plant 10 through a further air supply duct 58 (burner comburent air) which is placed in fluid connection with such first heat generator 52.

Between the second return circuit 24 and the second delivery circuit 48 there is also interposed at least one second fan 54, which is designed to transfer—to the second delivery duct 48—the air and/or the fumes coming from the second return circuit 24. Between the second delivery duct 48 and the second delivery circuit 20 there is therefore also interposed at least one second heat generator 56, such as for example a burner, which is designed to heat and dry the air and fumes coming from the second delivery duct 48, as well as further air coming from the environment outside the plant 10 through a further air supply duct 60 (burner comburent air) which is placed in fluid connection with such second heat generator 56.

According to the invention, between the first return circuit 22 connected to the first wet half-hood 14 and the second return circuit 24 connected to the second dry half-hood there is interposed at least one third interface duct 38. This third interface duct 38 is independent both from the first interface duct 26, on which there are installed the valves 28 and 30 for replenishing pre-heated air, and from the second interface duct 32, on which there are installed the valves 34 and 36 for extracting fumes.

Along the third interface duct 38 there is installed at least one fifth flow regulating device 40 which, as shown by the arrows of FIG. 1, is designed to allow the fluid to flow bidirectionally between the first return circuit 22 and the second return circuit 24 through the third interface duct 38. Also this fifth flow regulating device 40 may preferably consist of a sealed regulating valve.

This fifth flow regulating device 40 allows, whenever need arises, to transfer the fumes coming from the first return circuit 22 of the first wet half-hood 14, which is arranged at the inlet side of the slurry of paper material on the Yankee cylinder 12, on the second return circuit 24 connected to the second dry half-hood 16, which is arranged at the outlet side of the slurry of paper material from the Yankee cylinder 12. In this operating mode, the first heat generator 52, which is connected to the first wet half-hood 14 remains activated, while the second heat generator 56, which is connected to the second dry half-hood 16, may remain switched off. From the second dry half-hood 16, all the fumes, that is the one coming from both half-hoods 14 and 16, may be released into the atmosphere through the exhaust pipe 44 and an appropriate adjustment of the valves 34 and 36 for extracting fumes. Basically, this is the reverse cascade operating mode. However, the bidirectionality of the fifth flow regulating device 40 also allows to obtain the direct cascade operating mode.

Basically, the method for controlling process fluids in the plant 10 described up to now may selectively comprise the steps of:

keeping the first flow regulating device 28, the second flow regulating device 30, the third flow regulating device 34 and the fourth flow regulating device 36 at least partially open, instead keeping only the fifth flow regulating device 40 closed; therefore, the first wet half-hood 14 and the second dry half-hood 16 operate simultaneously, without fluid exchange between the respective first return circuit 22 and second return circuit 24;

or:

keeping the first flow regulating device 28, the fourth flow regulating device 36 and the fifth flow regulating device 40 at least partially open, instead keeping the second flow regulating device 30 and the third flow regulating device 34 closed; this allows the unidirectional fluid exchange between the second return circuit 24 and the first return circuit 22, so that the fumes coming from the second dry half-hood 16 are sent to the first wet half-hood 14, according to the direct cascade operating mode;

or:

keeping the second flow regulating device 30, the third flow regulating device 34 and the fifth flow regulating device 40 at least partially open, instead keeping the first flow regulating device 28 and the fourth flow regulating device 36 closed; this allows the unidirectional fluid exchange between the first return circuit 22 and the second return circuit 24, so that the fumes coming from the first wet half-hood 14 are sent to the second dry half-hood 16, according to the reverse cascade operating mode.

Therefore, it has been observed that the system and the method for controlling process fluids in a plant for manufacturing web-like paper material according to the present invention attain the objects outlined above. The introduction of a specific bidirectional flow regulating device into the plant allows the plant to operate selectively according to three different working conditions of the half-hoods, ensuring maximum operating flexibility of the plant for all possible paper manufacturing grammage.

The system for controlling process fluids of the present invention thus conceived is in any case susceptible to various modifications and variants, all falling within the same inventive concept; furthermore, all details can be replaced by technically equivalent elements. Basically, the materials used as well as the shapes and dimensions may vary according to the technical needs.

Therefore, the scope of protection of the invention is defined by the attached claims.

The invention claimed is:

1. A plant (10) for manufacturing a web-like paper material starting from a slurry of paper material to be desiccated, the plant (10) comprising:

a first drying device comprising at least one rotating Yankee cylinder (12), fed by pressurized steam, wherein said slurry of paper material dynamically adheres to the lateral surface of said Yankee cylinder (12);

a second drying device comprising at least one hood (14, 16) which at least partially surrounds said Yankee cylinder (12), wherein said hood (14, 16) comprises a first half-hood (14) and at least one second half-hood (16) which are both configured to blowing high temperature dry air onto said slurry of paper material wound on the lateral surface of said Yankee cylinder (12), and to suction hot and moist fumes, released by said slurry of paper material, wherein said first half-hood (14) is a wet half-hood arranged at the inlet side of said slurry of paper material on said Yankee cylinder (12), and wherein said second half-hood (16) is a dry half-hood arranged at the outlet side of said slurry of paper material from said Yankee cylinder (12);

at least one first delivery circuit (18) for feeding said high temperature air to said first half-hood (14);

at least one second delivery circuit (20) for feeding said high temperature air to said second half-hood (16);

at least one first return circuit (22) for suctioning said fumes from said first half-hood (14);

at least one second return circuit (24) for suctioning said fumes from said second half-hood (16);

a first interface duct (26) for a fluid connection between said first return circuit (22) and said second return circuit (24), wherein along said first interface duct (26) there are installed a first flow regulating device (28), which is configured to allow the fluid to flow unidirectionally from said first interface duct (26) to said first return circuit (22), and a second flow regulating device (30), which is configured to allow the fluid to flow unidirectionally from said first interface duct (26) to said second return circuit (24); and a second interface duct (32) for a fluid connection between said first return circuit (22) and said second return circuit (24), wherein said second interface duct (32) is arranged upstream of said first interface duct (26) and wherein along said second interface duct (32) there are installed a third flow regulating device (34), which is configured to allow the fluid to flow unidirectionally from said first return circuit (22) to said second interface duct (32), and a fourth flow regulating device (36), which is configured to allow the fluid to flow unidirectionally from said second return circuit (24) to said second interface duct (32), wherein between said first return circuit (22) and said second return circuit (24) there is interposed at least one third interface duct (38), which is independent from said first interface duct (26) and from said second interface duct (32), wherein along said third interface duct (38) there is installed at least one fifth flow regulating device (40), which is configured to allow the fluid to flow bidirectionally between said first return circuit (22) and said second return circuit (24) through said third interface duct (38).

2. The plant (10) according to claim 1, further comprising at least one air supply duct (42), which is placed in fluid connection with said first interface duct (26) and which is configured to supply air, coming from the environment outside the plant (10), to said first (28) and second (30) flow regulating device.

3. The plant (10) according to claim 1, further comprising at least one exhaust pipe (44), which is placed in fluid connection with said second interface duct (32) and which is configured to discharge at least one part of the fumes which flow through said second interface duct (32).

4. The plant (10) according to claim 2, further comprising at least one first delivery duct (46), which is placed in fluid connection with said first delivery circuit (18) and with said first return circuit (22) and which is configured to send to said first delivery circuit (18) at least one part of the fumes which flow through said first return circuit (22) and at least one part of the air coming from said at least one air supply duct (42).

5. The plant (10) according to claim 4, wherein: —between said first return circuit (22) and said first delivery duct (46) there is interposed at least one first fan (50), which is configured to transfer to said first delivery duct (46) the air or fumes coming from said first return circuit (22); and between said first delivery duct (46) and said first delivery circuit (18) there is interposed at least one first heat generator (52), which is configured to heat both the air and fumes coming from said first delivery duct (46), and further air coming from the environment outside the plant (10) through a further air supply duct (58) which is placed in fluid connection with said first heat generator (52).

6. The plant (10) according to claim 2, further comprising at least one second delivery duct (48), which is placed in fluid connection with said second delivery circuit (20) and with said second return circuit (24) and which is configured to send to said second delivery circuit (20) at least one part of the fumes which flow through said second return circuit (24) and at least one part of the air coming from the air supply duct (42).

7. The plant (10) according to claim 5, wherein: —between said second return circuit (24) and said second delivery duct (48) there is interposed at least one second fan (54), which is configured to transfer to said second delivery duct (48) the air or fumes coming from said second return circuit (24); and—between said second delivery duct (48) and said second delivery circuit (20) there is interposed at least one second heat generator (56), which is configured to heat and dry both the air and fumes coming from said second delivery duct (48), and further air coming from the environment outside the plant (10) through a further air supply duct (60) which is placed in fluid connection with said second heat generator (56).

8. The plant (10) according to claim 1, wherein at least one of said first (28), second (30), third (34), fourth (36) and fifth (40) flow regulating device comprises a sealed regulating valve.

9. The plant (10) according to claim 7, wherein at least one of said first (52) and second (56) heat generator comprises a burner.

10. A method for controlling process fluids in a plant (10) for manufacturing a web-like paper material according to claim 1, the method selectively comprising the steps of:—keeping said first (28), second (30), third (34) and fourth (36) flow regulating devices at least partially open and keeping said fifth flow regulating device (40) closed, so that said first half-hood (14) and said second half-hood (16) operate simultaneously, without fluid exchange between said first return circuit (22) and said second return circuit (24); or—keeping said first (28), fourth (36) and fifth (40) flow regulating devices at least partially open and keeping said second (30) and third (34) flow regulating devices closed, so that there is allowed the unidirectional fluid exchange between said second return circuit (24) and said first return circuit (22), so that the fumes coming from said second half-hood (16) are sent to said first half-hood (14); or— keeping said second (30), third (34) and fifth (40) flow regulating devices at least partially open and keeping said first (28) and fourth (36) flow regulating devices closed, so that there is allowed the unidirectional fluid exchange between said first return circuit (22) and said second return circuit (24), so that the fumes coming from said first half-hood (14) are sent to said second half-hood (16).

* * * * *